United States Patent [19]

Deike

[11] Patent Number: 4,603,520

[45] Date of Patent: Aug. 5, 1986

[54] POST MOUNTING ANCHOR BASE

[75] Inventor: Robert F. Deike, Cheyenne, Wyo.

[73] Assignee: Construction Robotics, Inc., Chicago, Ill.

[21] Appl. No.: 693,372

[22] Filed: Jan. 22, 1985

[51] Int. Cl.[4] ..... E04B 1/00

[52] U.S. Cl. ..... 52/98; 52/160; 52/296; 52/157

[58] Field of Search ..... 52/98, 157, 296, 170, 52/146–166; 404/71

[56] References Cited

U.S. PATENT DOCUMENTS

| | | | |
|---|---|---|---|
| 3,011,597 | 12/1961 | Galloway et al. | 52/157 X |
| 3,152,668 | 10/1964 | Smith | 52/148 |
| 3,186,523 | 6/1965 | Brisse | 52/149 |
| 3,676,965 | 7/1972 | Deike | 52/98 |
| 4,320,608 | 3/1982 | Deike | 52/165 |
| 4,339,899 | 7/1982 | Klenk et al. | 52/157 |

*Primary Examiner*—Carl D. Friedman
*Assistant Examiner*—Naoko N. Slack
*Attorney, Agent, or Firm*—Hill, Van Santen, Steadman & Simpson

[57] ABSTRACT

A ground anchor provides a mounting base for a sign post accommodating rotational, tilting, and height adjustments of the post and providing for release of the post at ground level in the event of impact by a vehicle so that no upstanding obstacle capable of causing injury will remain after impact. An angle iron leg with upstanding fins or spade members at the leading and trailing ends thereof is driven or otherwise buried into the ground. A tubular member seated in the channel of the angle iron is bolted to the legs or sides of the angle iron at a selected level to present a top edge or rim supporting an anchor plate with a central raised fragmental spherical dome. The anchor plate is fixedly secured to the tube by bolts threaded into upstanding lugs secured to the tube. The post has a fixed base plate on the bottom thereof resting on the spherical projection and shear bolts extending through slots in the anchor plate and holes in the peripheral marginal portion of the base plate clamp the base plate on the spherical projection of the anchor plate. These bolts can be adjusted to tilt the post relative to the anchor and the bolts can slide in the slots to accommodate rotational indexing of the post. Ground anchored cables are tensioned to the tubular member to further fix the leg in the ground.

11 Claims, 5 Drawing Figures

POST MOUNTING ANCHOR BASE

FIELD OF THE INVENTION

This invention relates to the art of adjustably mounting posts and other structural members to ground anchors and specifically deals with highway post anchors accommodating height, tilting, and rotational adjustments of the post while providing for release of the post from the anchor upon impact.

DESCRIPTION OF THE PRIOR ART

In my U.S. Pat. No. 3,676,965, issued July 18, 1972, I have described and claimed an adjustable break away mounting for ground anchored posts where the ground anchor itself has an upstanding tubular body receiving in the top open mouth thereof a ball projection on the bottom of a post. While this mounting accommodated tilting of the post relative to the anchor, height adjustments and rotational adjustments of the post relative to the anchor were not accommodated.

It would now be an improvement in this art to provide adjustable ground anchor mountings for posts and the like structural members which accommodate height, tilting, and rotational adjustments of the post and it would be a specific improvement in this art to provide such adjustments on angle iron leg ground anchors.

SUMMARY OF THE INVENTION

This invention now provides adjustable ground anchor base supports for mounting posts and the like structural members accommodating height, tilt and rotation adjustments of the post and free break away of the post from the anchor upon impact without leaving an upstanding residual structure that could cause injury. The ground anchor has an angle iron leg with spade or fin plates spanning the channel of the leg and extending laterally to provide fins which will retain the leg in upright position in the ground and will also facilitate driving of the leg into the ground. A tubular member is seated in the channel of the leg at an adjustable level to present a top end rim substantially flush with the top of the ground into which the leg has been driven. A flat anchor plate with a central raised rounded projection or dome is bottomed on the rim of the tubular member and fixedly secured to the tube. A post or other structural member with a flat base plate rests on the projection and has arcuate slots receiving shear bolts from the anchor plate so that the post plate can be tilted and rotated on the anchor plate. Since the tube can be raised and lowered on the angle iron leg, the post is also vertically adjusted. The shear bolts will fracture when the post is impacted by a vehicle, leaving it free to fall to the ground without any anchor portion projecting above the ground to cause damage to the vehicle.

The rounded projection on the tube mounted anchor plate accommodates tilting of the post in all directions so that its upright attitude can be accurately controlled regardless of variations of the attitude of the anchor in the ground thus accommodating driving of the anchor into the ground at an angle without requring the post to project this angle. Further, the post can be rotated relative to the ground anchor to accurately face a sign on the post exactly as desired. In addition, the vertical adjustment of the tube on the angle iron leg accurately controls the height of the anchor plate and post.

Ground anchored cable guy lines may be attached to the tube to further secure and retain the angle iron leg in the ground.

It is then an object of this invention to provide a post mounting anchor base accommodating tilting, rotating, and height adjustments of the post.

A further object of this invention is to provide a post mounting for angle iron leg type ground anchors which will free the post from the anchor upon impact by a vehicle or the like.

Another object of this invention is to provide a ground anchor with a leg driven into the ground and with tensioned cable means retaining the leg in upright position in the ground.

Other and further objects of this invention will become apparent to those skilled in this art from the following detailed description of the annexed sheet of drawings which shows best mode embodiments of the invention.

ON THE DRAWINGS

AS SHOWN ON THE DRAWINGS

Figures 1, 2, 3, 4, 5:
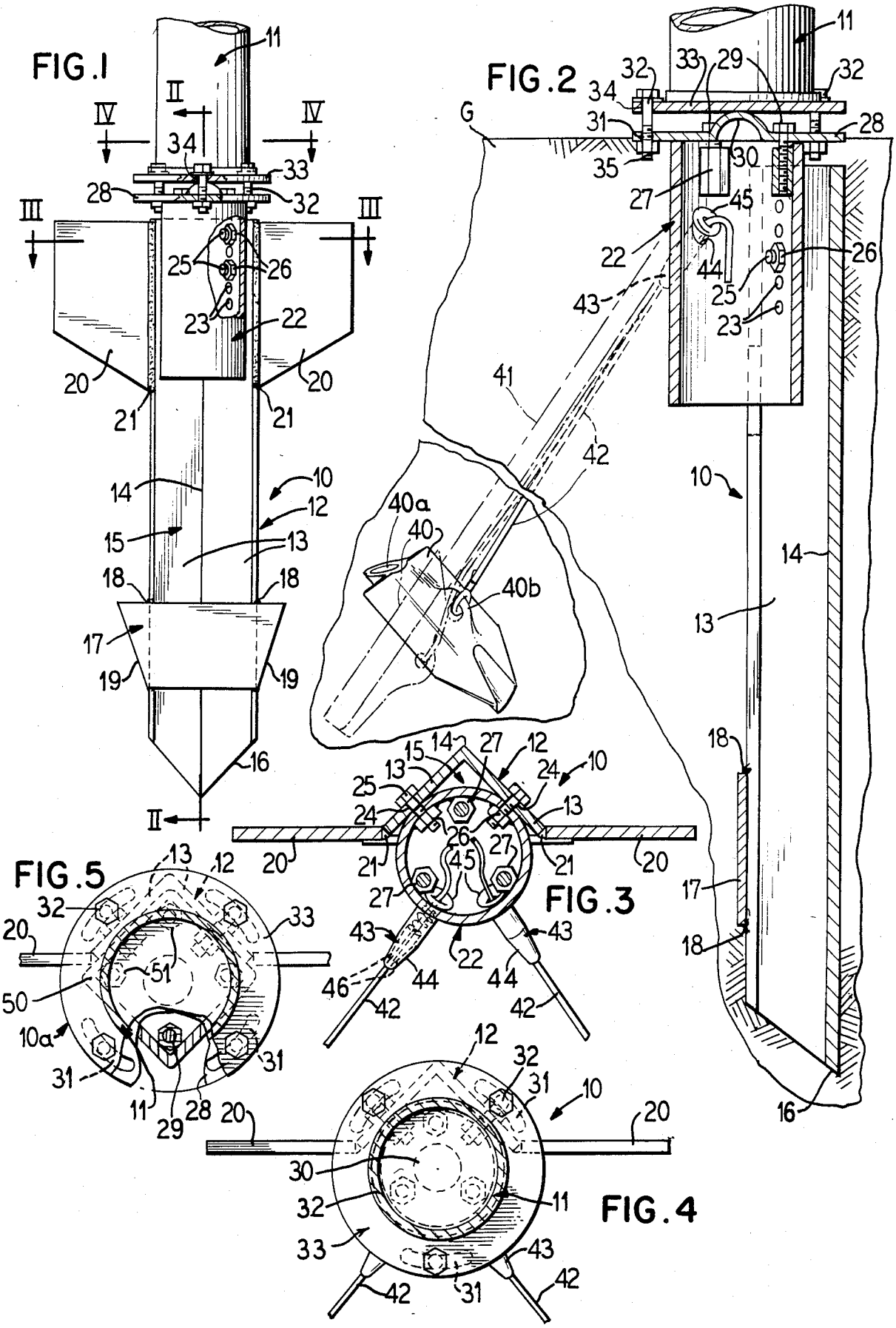
FIG. 1 is a front elevational view of a post mounting anchor base according to this invention illustrating the manner in which a post is mounted thereon.
FIG. 2 is a longitudinal sectional view along the line II—II of FIG. 1 showing the anchor in the ground with the post base plate above ground.
FIG. 3 is a transverse sectional view along the line III—III of FIG. 1.
FIG. 4 is a transverse cross-sectional view along the line IV—IV of FIG. 1.
FIG. 5 is a view similar to FIG. 4 illustrating a modified embodiment.

A post mounting anchor base 10 of FIGS. 1–4 mounts a sign post 11 in upright position. The anchor 10 has an angle iron leg 12 with sides 13 in right angle relation diverging from an apex 14 and providing an open face channel 15. The leg has a pointed end 16. A flat spade plate 17 spans the open face or channel 15 of the angle iron leg and is welded to the ends of the sides 13 as illustrated at 18. This plate 17 has tapered sides 19 diverging from the end edges of the sides 13 to project from the angle iron forming stabilizing fins. The plate 17 is positioned adjacent the leading end 16.

The upper or trailing end of the angle iron leg 12 has fin plates 20,20 extending laterally from the ends of the sides 13 and welded to the ends as illustrated at 21. These fin plates 20 also stabilize the leg 12 against tilting in the ground and assist in driving the leg upright into the ground.

The upper or trailing end of the leg 12 receives a cylindrical tube 22 in the channel 15 thereof. This tube has two rows of bolt holes 23 spaced along the length thereof to register with bolt holes 24 in both sides 13 of the angle iron leg 12. Bolts 25 extend through these bolt holes 24 and through selected holes 23 in the tube 22 to secure the tube 22 at a desired level in the channel 15 of the leg 12. Nuts 26 clamp the tube 22 to tube 22 to the leg 12. The tube 22 is relatively short, projecting into the upper end of the channel 15 for about the height of the fin plates 20. For example, the leg 12 can be from 1 to 3 feet in length, the fin plates 20 can be 5 to 10 inches high and the tube 22 will be of commensurable size permitting it to project above the top of the leg. The spade plate 17 is generally of less height than the fins 20.

The interior of the tube 22 has circumferentially spaced upright internally threaded lugs 27 welded thereto. As illustrated in FIG. 3, three such lugs are equally spaced around the inner circumference of the tube 22.

A circular anchor plate 28 of larger diameter than the tube 22 is seated on the top edge or rim of the tube and is fixedly bolted to the tube by bolts 29 extending through the plate and threaded into the lugs 27. The anchor plate 28 has a raised hemispherical central projection or dome 30 overlying the central portion of the tube 22.

The projecting peripheral margin of the anchor plate 28 has arcuate slots 31 with radii centered on the center of the plate 28 spaced equally around the circumference thereof to receive shear bolts 32, four being preferred.

The post 11 has a flat base plate 33 spanning the bottom thereof and projecting therefrom to a diameter about equal to the diameter of the anchor plate 28. This plate 33 is welded or otherwise affixed to the post 11.

Bolt holes 34 are spaced equally around the peripheral margin of the plate 33 and receive the shear bolts 32. The plate 33 rests on the rounded projection 30 of the plate 28 and the shear bolts 32 extending through the slots 31 and bolt holes 34 are tightened by nuts 35 to clamp the plate 33 tightly against the projection 30. The bolts 32 can be adjustably threaded into their nuts 35 so that the post can be held in a fixed attitude relative to the anchor plate 28. Thus, the post can tilt in all directions relative to the ground anchor 10 and can be locked in the adjusted tilted position.

In addition, the slots 31 permit rotation of the plate 33 relative to the plate 28 so that the post can be rotated, for example, to face a sign thereon in the desired direction. Alternately the slots 31 could be placed in the plate 33 with the bolt holes 34 in the plate 28.

In addition the tube 22 can be raised and lowered relative to the anchor leg 12 and thus the height of the post 11 and anchor plate 28 can be adjusted.

To further hold the ground anchor leg 12 in fixed position in the ground G, as shown in FIGS, 2 and 3, ground anchors 40 can be driven into the ground at an angle relative to the post leg 12 and in a direction facing oncoming traffic that might be encountered by the post. These anchors have open top sockets 40*a* receiving a drive rod 41 which will drive them endwise into the ground carrying a cable 42 therewith parallel to the rod 41. One end of the cable 42 is looped through an eye 40*b* of the anchor 40. The other end of the cable 42 is threaded through a clamping socket 43 with a casing 44 projecting through a hole in the tube 22 and with a flange 45 on the casing bottomed in the tube. These clamps have internal conical spring-loaded grips 46 permitting passage of the cable therethrough into the tube as illustrated in FIG. 2. The cables 42 are tensioned to rotate the anchors 40 to their locked positions in the ground and the gripping mechanism 46 in the members 43 will hold these cables in their tensioned taut condition. The leg 10 is therefore reinforced against tilting or movement in the ground by the additional anchors 40 and their taut cables 42.

In the embodiment 10*a* illustrated in FIG. 5, parts corresponding with parts described in FIGS. 1–4 have been marked with the same reference numerals. In the embodiment 10*a*, however, the cylindrical tube 22 is replaced with a square tube 50 carrying a threaded lug 51 in each of the four corners thereof to receive the connecting bolts 29. The square tube 50 has two of its sides seated in the sides 13 of the anchor leg 12. The square tube 50 is vertically adjusted on the leg 12 in the same manner as the cylindrical tube 22 and carries the same plate 28 with the rounded projection supporting the base plate 33 on the post 11.

From the above descriptions it will be therefore be understood that this invention provides a simplified post mounting anchor base permitting the post to be adjusted in height, tilt, and rotation relative to the ground anchor while accommodating a clean break away when the post is impacted.

I claim as my invention:

1. An adjustable break away mounting for posts on ground anchors which comprises a leg adapted to be driven upright into the ground to provide a ground anchor, an anchor plate overlying said leg and having depending means overlapping said leg, said leg and said depending means having preformed cooperating fastener receiving holes adapted to register at a plurality of locations, fasteners in selected registering holes fixedly securing the depending means to position the anchor plate at a selected level to control height of the anchor plate relative to the ground, said anchor plate having a central raised dome portion, a post having a base plate on the bottom thereof tiltably supported on said dome portion, shear bolts drawing the post base plate into clamped engagement with the domed portion of the anchor plate, means accommodating rotation of the post base plate relative to the anchor plate whereby the height, tilt, and rotation of the post relative to the leg is selectively controlled and the shear bolts will fracture upon impact of the post to cleanly separate the post from the leg.

2. The mounting of claim 1 wherein the leg is an angle iron, and the means adjustably secured to the upper end thereof is a tube nested in the channel of the angle iron.

3. The mounting of claim 2 wherein the tube is cylindrical.

4. The mounting of claim 2 wherein the tube is square.

5. The mounting of claim 1 including ground anchored cable means secured to the mounting depending means.

6. A post anchor which comprises a leg adapted to be driven into the ground in submerged relation therewith, an upright tube overlapping said leg, means having a plurality of settings for securing said tube to the upper end of said leg at selected levels, an anchor plate secured to the upper end of the tube extending radially beyond the tube and leg and having a central rounded raised projection, a post having a base plate on the bottom end thereof tiltably supported on said projection, draw bolts extending through the peripheral marginal portions of the anchor plate and base plate to clamp the base plate on the rounded projection, one of said plates having arcuate slots receiving said draw bolts to accommodate rotation of the base plate relative to the anchor plate, and said draw bolts being adjustable to control the tilting of the base plate relative to the anchor plate whereby said post is adjustable in height, angular attitude, and rotation relative to the leg.

7. The post anchor of claim 6 including a ground anchored cable, and a cable grip socket bottomed on the tube adjustably securing the cable in taut condition to the tube for further anchoring the leg in the ground.

8. A post anchor which comprises an angle iron leg adapted to be driven upright into the ground and flush with the surface thereof, a tube seated in the channel of said leg at the upper end thereof, bolts having a plurality of settings for securing the tube to the sides of the angle iron leg at selected levels to position the top rim end of the tube at a desired height, an anchor plate covering the tube and projecting radially therebeyond, means securing the anchor plate to the top rim of the tube, a base plate overlying the mounting plate, a rounded dome projection between the base plate and anchor plate accommodating tilting of the base plate relative to the anchor plate, said anchor plate having arcuate slots in the peripheral margin thereof, said base plate having bolt holes registering with said slots, shear bolts extending through the slots and bolt holes clamping the base plate on the projection to secure the two plates together at a selected angular relationship, said slots accommodating rotation of the anchor plate relative to the anchor plate, and a post fixedly secured to the base plate whereby said post may be raised and lowered by raising and lowering the tube on the angle iron leg, may be tilted by adjusting the shear bolts, and may be rotated by loosening the shear bolts to accommodate movement thereof in said slots.

9. The post anchor of claim 8 wherein the leg has a spade blade spanning the channel thereof fixedly secured to the sides of the leg and projecting beyond said sides at the leading end of the leg.

10. A post anchor of claim 8 wherein the leg has fins radiating from the divergent ends of the sides of the leg at the upper end thereof.

11. The post anchor of claim 8 including two circumferentially spaced vertical rows of bolt holes in the tube positioned to overly the sides of the angle iron leg to selectively receive the bolts.

* * * * *